US006652145B2

(12) United States Patent
Valdez

(10) Patent No.: US 6,652,145 B2
(45) Date of Patent: Nov. 25, 2003

(54) VENTILATED SPORT BAG WITH DETACHABLE WATERPROOF COVER

(76) Inventor: Homero Valdez, 202 17th St., Apt. A, Huntington Beach, CA (US) 85716

( * ) Notice: Subject to any disclaimer, the term of this patent is extended or adjusted under 35 U.S.C. 154(b) by 0 days.

(21) Appl. No.: 10/078,901

(22) Filed: Feb. 19, 2002

(65) Prior Publication Data

US 2003/0156767 A1 Aug. 21, 2003

(51) Int. Cl.[7] ..... B65D 33/01

(52) U.S. Cl. ..... 383/102; 383/97; 383/111; 383/117; 190/108

(58) Field of Search ..... 383/111, 117, 383/110, 102, 97; 150/105, 113; 190/110, 108

(56) References Cited

U.S. PATENT DOCUMENTS 4,887,751 A * 12/1989 Lehman ..... 224/579
5,207,254 A * 5/1993 Fromm ..... 150/104
5,413,199 A * 5/1995 Clement ..... 190/108
5,533,558 A * 7/1996 Carey et al. ..... 150/105
5,603,573 A * 2/1997 Mercier et al. ..... 383/117
6,129,126 A * 10/2000 Restivo ..... 150/105
6,193,034 B1 * 2/2001 Fournier ..... 190/107
6,386,414 B1 * 5/2002 Kilduff ..... 224/638
6,446,851 B1 * 9/2002 Parks et al. ..... 224/655

* cited by examiner

*Primary Examiner*—Jes F. Pascua
(74) *Attorney, Agent, or Firm*—Durando Birdwell & Janke, PLC

(57) ABSTRACT

A ventilated sport bag having a permeable inner layer and a detachable impermeable outer layer is disclosed. The permeable inner layer allows moisture to evaporate so that the sport item will not become mildewed, discolored, or rust. When a wet sport item is placed in the bag, the impermeable outer layer is detached so that the item can dry. The inner layer is comprised of two portions of material that are formed in the shape of the bag. The outer layer is comprised of two cover portions that cover the two inner layer portions. The outer cover portions are attached to the inner layer portions by an attachment device such as a zipper. When the outer cover wears out it can be replaced without having to purchase an entire new bag. A handle and a detachable shoulder strap are also provided.

11 Claims, 2 Drawing Sheets

VENTILATED SPORT BAG WITH DETACHABLE WATERPROOF COVER

FIELD OF INVENTION

This invention relates to bags that provide ventilation, and particularly to a sport bag that is permeable so as to dry a sport item, but can be made impermeable after the item has dried.

BACKGROUND OF THE INVENTION

Bags are used to carry sports items to and from the place where the items are used, and for storage of the sports items afterwards. Often, a sport item is used in a moist or wet environment, and is wet when placed in the bag. Placing a wet sport item in a closed, impermeable bag can lead to the growth of mildew, and the water can rust or discolor the sport item. It is thus desirable for a sport bag to allow for the evaporation of moisture. However, if the bag is water permeable, outside moisture can enter the bag, thus allowing the growth of mildew and the discoloration and rusting of the sport item.

There are ventilated and water resistant bags available on the market that are made from laminated materials. The bags permit moisture from inside to exit, while preventing outside moisture to enter. A disadvantage of these bags is that the laminated material is expensive to manufacture. In addition, if the moisture content inside the bag is too high, the moisture will not evaporate quickly enough, and the sport item may be damaged by mildew or rust. The evaporation of moisture from the bag is dependent on the number and size of the pores in the material. The number and size of the pores are dependent on the sport item that is being carried or stored. If the pores are too large, or too dense, moisture can enter the bag from the outside, thus allowing the item to be damaged.

Another disadvantage of the laminated sport bag is that the laminated material used to make the bag is quite thin and does not provide much support or protection for the sport item. In addition, the laminated material is not durable and tends to lose its mildew and rust preventing properties quickly.

Consequently, there is a need for a sport bag that can be made permeable or impermeable as needed, is inexpensive to manufacture, is made from durable material, and can be custom designed for a sport item so that it provides the desired amount of ventilation, support, and protection.

SUMMARY OF THE INVENTION

The aforementioned need has been met in the present invention by providing a ventilated sport bag that has a permeable inner layer and a detachable impermeable outer layer. The permeable inner layer of the sport bag allows moisture to evaporate so that the sport item will not become mildewed, discolored, or affected by rust. When a wet sport item is placed in the bag, the impermeable outer layer is detached so that the item can dry. The inner layer is comprised of two portions of material that are formed in the shape of the bag. The two portions are sewn together partway around their edges to form a compartment for storage of the sport item, but leaving an opening through which the sport item is inserted. After the sport item has been inserted in the compartment, the remaining edges of the two portions are attached with a fastening device such as a zipper.

The outer layer is comprised of two cover portions that cover the two inner layer portions. The outer cover portions are attached to the inner layer portions by an attachment device such as a zipper. In this way, the outer cover portions can be attached and detached as desired. In addition, the outer cover provides extra protection for the sport item. When the outer cover wears out, it can be replaced without having to purchase an entire new bag. Outer covers of different patterns can be utilized to change the look of the bag.

A handle is attached to the top of the bag for ease of transport and can be used to hang the bag on a hook. A detachable shoulder strap is also provided.

Accordingly, it is the principal object of the present invention to provide a novel and improved ventilated bag for carrying a sport item.

It is another object of the invention to provide a ventilated sport bag that can be made water permeable to dry the sport item, but can be made water impermeable when the item is dry.

It is a further object of the invention to provide a ventilated sport bag that is inexpensive and of increased durability.

It is yet another object of the invention to provide a sport bag whose outer design pattern can be changed when desired.

It is a still further object of the invention to provide a sport bag that allows air to flow through it when desired, yet can prevent air flow when necessary to protect the sport item from the outside elements.

The foregoing and other objects, features, and advantages of the invention will be more readily understood upon consideration of the following detailed description of the invention, taken in conjunction with the accompanying drawings.

DETAILED DESCRIPTION OF THE INVENTION

Figure 1:
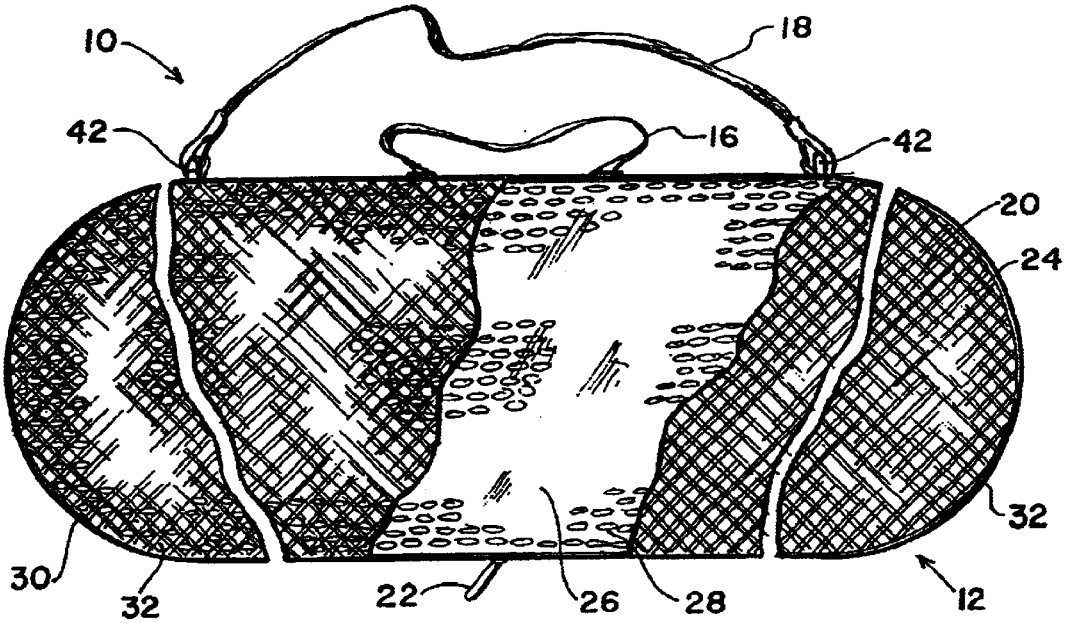
FIG. 1 is a partially cut-out side view of the ventilated sport bag according to the present invention with the impermeable outer layer removed and the permeable inner layer partially cutaway to show the three distinct portions of the permeable inner layer.
Figure 2:
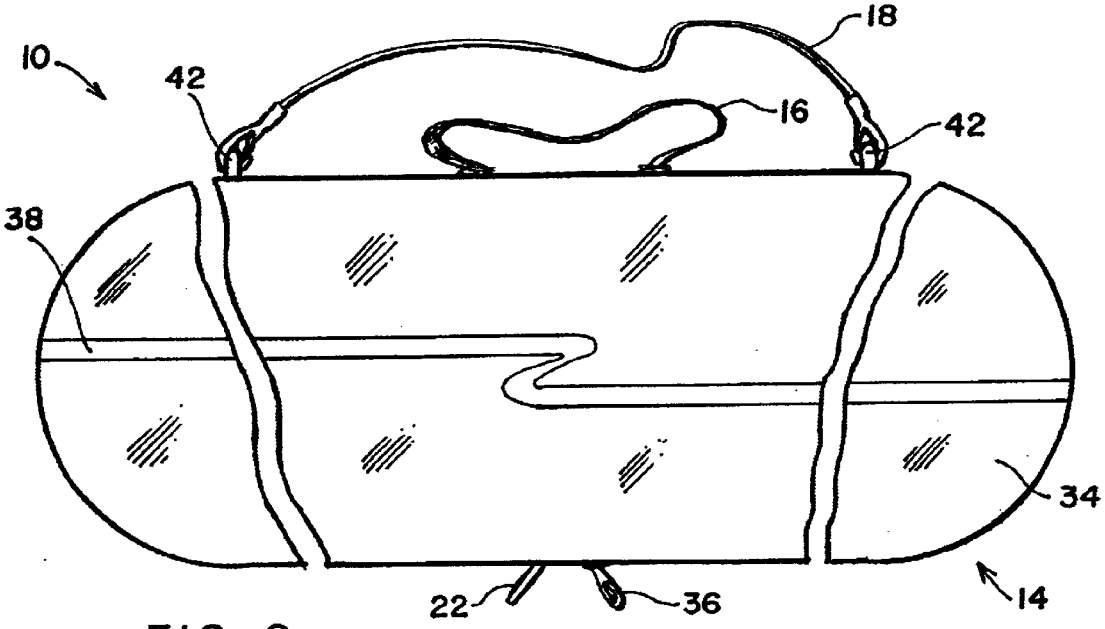
FIG. 2 is a partially cut-out side view of the ventilated sport bag of FIG. 1 with the impermeable outer layer attached.

A preferred embodiment of the present invention is shown in FIGS. 1–4. Referring to FIGS. 1 and 2, the ventilated sport bag 10 consists of a permeable inner layer 12, as shown in FIG. 1, an impermeable outer layer 14, as shown in FIG. 2, a handle 16, and a removable strap 18.

The permeable inner layer 12 is comprised of a first portion 20 and a second portion (not shown). The first portion 20 rests on top of the second portion to form the shape of the ventilated sport bag 10. The edges of the first 20 and second portions are sewn together around about an eighth of their respective edges, thus forming a compartment therebetween for storing the sport item. The edges of the first 20 and second portions that are not sewed are connected by an attachment member 22, which can be opened and closed in order to insert the sport item into the ventilated sport bag 10. The attachment member 22 shown in FIG. 1 is a zipper 22, but other attachment members can be used without departing from the principles of the invention. When the sport item is placed between the first 20 and second portions of the permeable inner layer 12, and the attachment member 22 is zipped, the sport item is completely surrounded and protected. The ventilated sport bag 10 in FIGS. 1–4 is shown as being sewed around about an eighth of its perimeter; however, other interconnection methods and distances can be used without departing from the principles of the invention.

The first 20 and second portion of the permeable inner layer 12 are each comprised of three inner layer portions. A first layer of mesh material 24 forms the bottom layer. An inner layer 26 forms a layer of cushioning material having perforations 28. Lastly, a top layer 30 forms a second layer of mesh material. The two mesh layers 24 and 30 have open spaces 32 which allow moisture to evaporate so that when a wet sport item is placed in the ventilated sport bag 10 it can dry, thus preventing mildew, rust, and discoloration. The mesh layers 24 and 30 can be netting, or other materials can be used without departing from the principles of the invention. The inner layer 26 is made of a cushioning material such as foam, and is used to provide cushioning and protection for the sport item. The cushioning material is not water permeable, so the perforations 28 have been added in order to make it water permeable. Other materials besides foam can be used without departing from the principles of the invention. In addition, the amount of layering and cushioning can be varied depending upon the sport item to be carried. In use, a wet sport item is placed in the ventilated sport bag 10 as shown is FIG. 1 so that the sport item has an opportunity to dry, or to prevent overheating.

Figure 4:
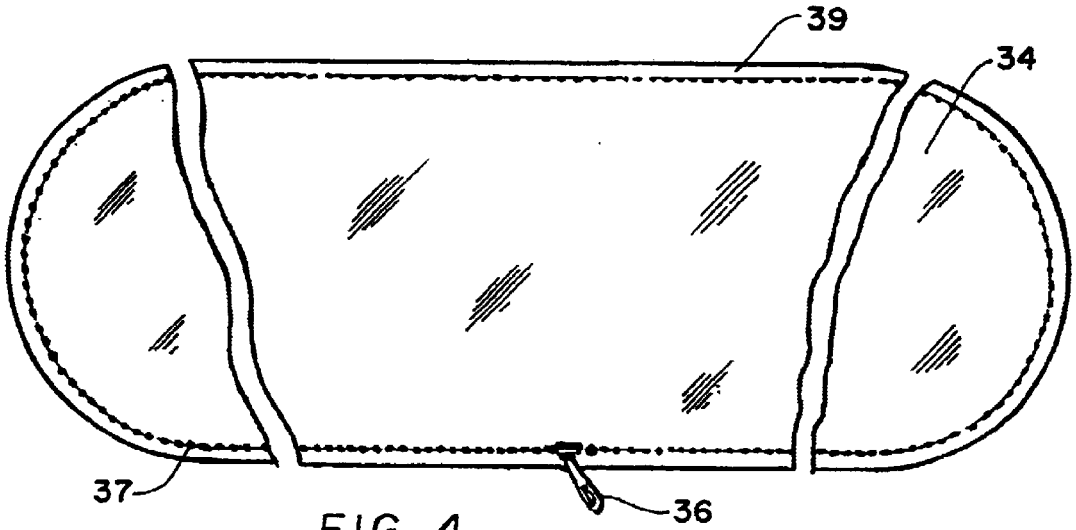
FIG. 4 is a partially cut-out side view of one portion of the impermeable outer layer of FIG. 2 removed and turned over to show a zipper.

After the sport item has dried, or in order to protect the sport item from outside elements, the outer impermeable layer 14 can be attached as shown in FIG. 2. The outer impermeable layer 14 is comprised of a first cover portion 34 and a second cover portion (not shown) that are shaped substantially like the permeable inner layer 12. The first 34 and second cover portions are attached respectively to the first 20 and second portions of the permeable inner layer 12 by an attachment member 36, which is preferably a zipper. The zipper 36 surrounds the perimeter of the inner layer 12 and the perimeter of the outer layer 14, preferably leaving a border 39 around the perimeter edge to cover the zipper after attachment, and zips the outer layer 14 to the inner layer 12. The toothed track 37 of the zipper 36 on the first cover portion 34 of the outer layer 14 is shown in FIG. 4. When the sport item needs to be dried or ventilated, the outer layer 14 is unzipped and removed as shown in FIG. 4, so that inner permeable layer 12 is exposed to the air.

Figure 3:
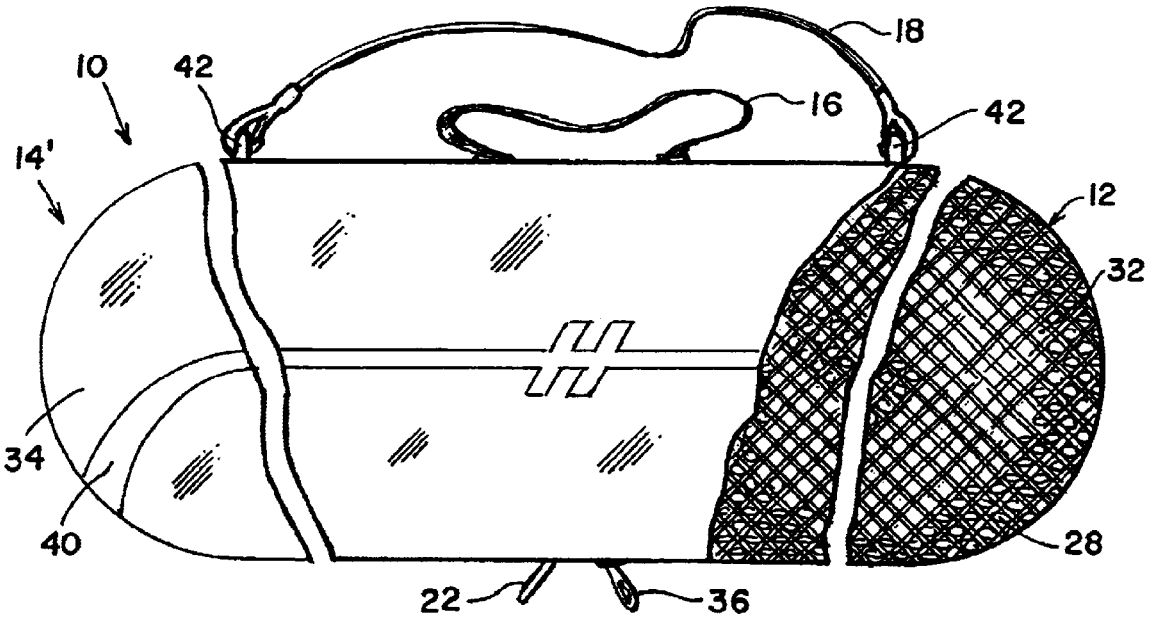
FIG. 3 is a partially cut-out side view of the ventilated sport bag of FIG. 1 having a different impermeable outer layer attached and being partially cutaway to show the permeable inner layer.

The outer layer 14 has a first design 38 as shown in FIG. 2. When the outer layer 14 wears out it can be replaced with a new outer layer 14' that has a second design 40. Alternatively, the new outer layer 14' can be used when a design change is desired, as illustrated in FIG. 3. The outer layer can be opaque to conceal the sport item, or translucent. The weave and color of material can be changed to obtain the desired effect. Multiple outer layers of different designs can be provided.

The handle 16 is centrally located and is used to transport the-ventilated sport bag 10. In addition, a person can use the removable strap 18 to keep his hands free. The removable strap 18 is attached to the bag 10 by two loops 42 which are located equidistance from the center of the bag. The removable strap 18 can be removed and then reattached when desired.

The ventilated sport bag 10 is shaped like a snowboard in the partially cut-out illustrations of the figures in order to carry a snowboard. However, other shapes such as for skis, tennis, roller blades and many others can be made without departing from the principles of the invention. In addition, the degree of permeability of the inner and outer layers can be varied depending on the type of sport item that is to be stored in the bag. The weight, durability, cushioning effect, color, and design of the sport bag can also be varied.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A ventilated bag for a sport item, comprising:

a permeable inner layer for allowing moisture to pass therethrough; and an impermeable outer layer for covering said permeable inner layer, said impermeable outer layer being detachably attachable to said bag over said permeable inner layer to prevent moisture from entering the bag when said outer layer is attached and to allow moisture to exit the bag through said permeable inner layer when said outer layer is detached;

wherein said permeable inner layer comprises a first layer of mesh material; and wherein said permeable inner layer further comprises a layer of cushioning material containing perforations for allowing moisture to pass therethrough, said layer of cushioning material being disposed over said first layer of mesh material on the outside thereof.

2. The ventilated sport bag of claim 1, wherein said cushioning material is foam.

3. The ventilating sports bag of claim 1, further comprising a second layer of mesh material disposed over said layer of cushioning material.

4. The ventilated sport bag of claim 1, wherein said permeable inner layer comprises a plurality of inner layer portions, said portions being at least partially interconnected to form a compartment to contain a sports item.

5. The ventilated sport bag of claim 4, wherein said portions are at least partially interconnected by an attachment device that is repeatably openable and closeable to form an opening into said compartment through which a sports item may be inserted and removed.

6. The ventilated sport bag of claim 5, wherein said attachment device is a zipper.

7. The ventilated sport bag of claim 4, wherein said impermeable outer layer comprises at least two selectively removable cover portions that cover said respective portions of said permeable inner layer.

8. The ventilated sport bag of claim 7, wherein said cover portions are shaped to substantially match the shape of respective portions of said inner layer, said cover portions being attached to said bag inner layer by one or more attachment members.

9. The ventilated sport bag of claim 8, wherein at least one of said attachment members comprises a zipper.

10. The ventilated sport bag of claim 1, further comprising a replacement impermeable outer layer to replace said impermeable outer layer when said impermeable outer layer has been detached from said ventilated sport bag.

11. The ventilated sport bag of claim 1, wherein said permeable inner layer is in the shape of a sport item.

* * * * *